US009202644B2

(12) United States Patent
Aoyama et al.

(10) Patent No.: US 9,202,644 B2
(45) Date of Patent: Dec. 1, 2015

(54) CORD SWITCH AND CORD SWITCH MOUNTING STRUCTURE

(71) Applicant: Hitachi Metals, Ltd., Tokyo (JP)

(72) Inventors: Takashi Aoyama, Hitachi (JP); Akira Yamaura, Fukuoka (JP); Shinichi Takaba, Hitachi (JP); Takashi Onimoto, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 58 days.

(21) Appl. No.: 14/243,803

(22) Filed: Apr. 2, 2014

(65) Prior Publication Data

US 2014/0318934 A1 Oct. 30, 2014

(30) Foreign Application Priority Data

Apr. 30, 2013 (JP) ..... 2013-095643

(51) Int. Cl.

| | |
|---|---|
| ***H01H 3/16*** | (2006.01) |
| ***H01H 3/60*** | (2006.01) |
| ***H01H 3/14*** | (2006.01) |
| ***E05F 15/44*** | (2015.01) |
| ***E05F 15/46*** | (2015.01) |

(52) U.S. Cl.

CPC ..... *H01H 3/60* (2013.01); *E05F 15/443* (2015.01); *E05F 15/46* (2015.01); *H01H 3/142* (2013.01); *H01H 3/161* (2013.01); *E05Y 2600/526* (2013.01)

(58) Field of Classification Search

CPC ..... H01H 3/142

USPC ..... 200/61.42, 61.43, 61.44, 61.62; 324/663

See application file for complete search history.

(56) References Cited

U.S. PATENT DOCUMENTS

| | | | | |
|---|---|---|---|---|
| 4,742,196 | A * | 5/1988 | Kelly | 200/86 R |
| 5,780,793 | A * | 7/1998 | Buchholz et al. | 200/61.44 |
| 6,078,014 | A | 6/2000 | Kashiwazaki et al. | |
| 6,316,846 | B1 | 11/2001 | Kashiwazaki et al. | |
| 7,055,885 | B2 * | 6/2006 | Ishihara et al. | 296/146.4 |
| 7,714,595 | B2 * | 5/2010 | Fujiwara et al. | 324/663 |
| 8,159,231 | B2 * | 4/2012 | Sakamaki | 324/663 |
| 8,191,311 | B2 * | 6/2012 | Sakamaki et al. | 49/27 |
| 9,059,712 | B2 * | 6/2015 | Ishihara | 1/1 |

FOREIGN PATENT DOCUMENTS

| | | | |
|---|---|---|---|
| JP | 04-126319 | A | 4/1992 |
| JP | 2000-205975 | A | 7/2000 |
| JP | 2005-302736 | A | 10/2005 |

* cited by examiner

*Primary Examiner* — Vanessa Girardi

(74) *Attorney, Agent, or Firm* — McGinn IP Law Group, PLLC

(57) ABSTRACT

A cord switch including a cord switch main body including a hollow tubular member having elasticity and electrical insulating property and a plurality of electrode wires provided to face each other with an interval at an inner surface of the tubular member and spaced from each other by the elasticity of the tubular member, and a mounting member having an elastic modulus greater than an elastic modulus of the tubular member and being provided along the cord switch main body. The cord switch also includes a strip-shaped impact absorption member having an elastic modulus lower than the elastic modulus of the tubular member, which is interposed between the cord switch main body and the mounting member.

9 Claims, 9 Drawing Sheets

CORD SWITCH AND CORD SWITCH MOUNTING STRUCTURE

The present application is based on Japanese Patent Application No. 2013-095643 filed on Apr. 30, 2013, the entire contents of which are incorporated herein by reference.

BACKGROUND OF THE INVENTION

1. Field of the Invention

The present invention relates to a cord switch and a mounting structure thereof

2. Description of the Related Art

Conventionally, a cord switch (i.e. a cable-type sensor), for example, provided on an electric sliding door of a vehicle for preventing an accident due to pinching has been known (see e.g., JP-A H04-126319 and JP-A 2005-302736).

JP-A H04-126319 discloses a cord switch comprising a pair of electrode wire provided parallel to each other at an inner surface of a tubular insulating member having elasticity. JP-A 2005-302736 discloses a cord switch four electrode wires provided helically within a tubular insulating member having the elasticity. These electrode wires are spaced from each other by the elasticity of a tubular insulating member. When an external force is applied to the cord switch as described above, the electrode wires contact each other so that the electrical resistance between the electrode wires changes. Thus, the application of the external force can be detected based on the change in the electrical resistance.

When the cord switch is installed in the sliding door for the vehicle, for example, as described in JP-A 2000-205975, the cord switch is received in a tubular protector rubber and the protector rubber is attached to the sliding door by adhesive and a rivet. For the protector rubber, the rubber materials which are harder than the tubular insulating member of the cord switch are used. The protector rubber has a function for fixing the cord switch and relaxing the impact applied to the cord switch increases, thereby protecting the cord switch.

SUMMARY OF THE INVENTION

In order to achieve the reduction in cost, it has been considered to avoid the use of the protector rubber and to attach the cord switch directly to a target object (i.e. object to be detected) such as sliding door by adhesive. However, in the case where no protector rubber is used, the damage of the cord switch will easily occur when a large impact is applied thereto since the external force is directly applied to the cord switch. That is, since the electrode wires are spaced from each other by the elasticity of the tubular insulating member, when a large impact is applied to the cord switch, the electrode wires may be damaged by a hard contact between the electrode wires or may come out from the inside of the insulating member.

Therefore, it is an object of the invention to provide a cord switch and a mounting structure thereof, which can suppress damage of the cord switch when a large impact is applied to the cord switch.

According to a feature of the invention, a cord switch comprises:

a cord switch main body comprising a hollow tubular member having elasticity and electrical insulating property and a plurality of electrode wires provided to face each other with an interval at an inner surface of the tubular member and spaced from each other by the elasticity of the tubular member;

a mounting member having an elastic modulus greater than an elastic modulus of the tubular member and being provided along the cord switch main body; and a strip-shaped impact absorption member having an elastic modulus lower than the elastic modulus of the tubular member and being interposed between the cord switch main body and the mounting member.

According to another feature of the invention, a cord switch mounting structure for mounting a cord switch main body comprising a hollow tubular member having elasticity and electrical insulating property and a plurality of electrode wires provided to face each other with an interval at an inner surface of the tubular member on a mounting member having an elastic modulus greater than an elastic modulus of the tubular member, the cord switch mounting structure comprises:

a strip-shaped impact absorption member having an elastic modulus lower than the elastic modulus of the tubular member and being interposed between the cord switch main body and the mounting member.

Effect of the Invention

According to the present invention, the damage of the cord switch can be suppressed when a large impact is applied to the cord switch.

BRIEF DESCRIPTION OF DRAWINGS

Next, the present invention will be explained in more detail in conjunction with appended drawings, wherein:

FIGS. 2A and 2B are cross-sectional views taken along A-A line of FIG. 1, wherein FIG. 2A shows the state where the load is applied to the cord switch, and FIG. 2B shows the state where the load is not applied to the cord switch, respectively;

DETAILED DESCRIPTION OF THE EMBODIMENTS

Figure 1:
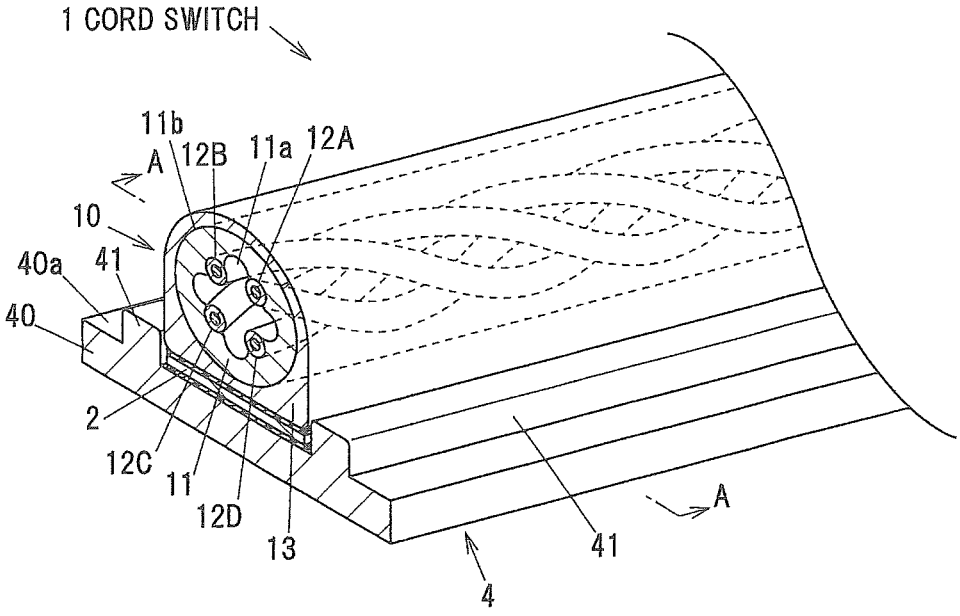
FIG. 1 is a perspective view of an essential part of a cord switch in the first embodiment according to the present invention.

Next, the embodiments of the invention will be described below with reference to the appended drawings. It should be noted that the same reference numerals are assigned to the constituent elements having substantially the same function, and the redundant explanation is omitted.

The First Embodiment

Figure 2A:
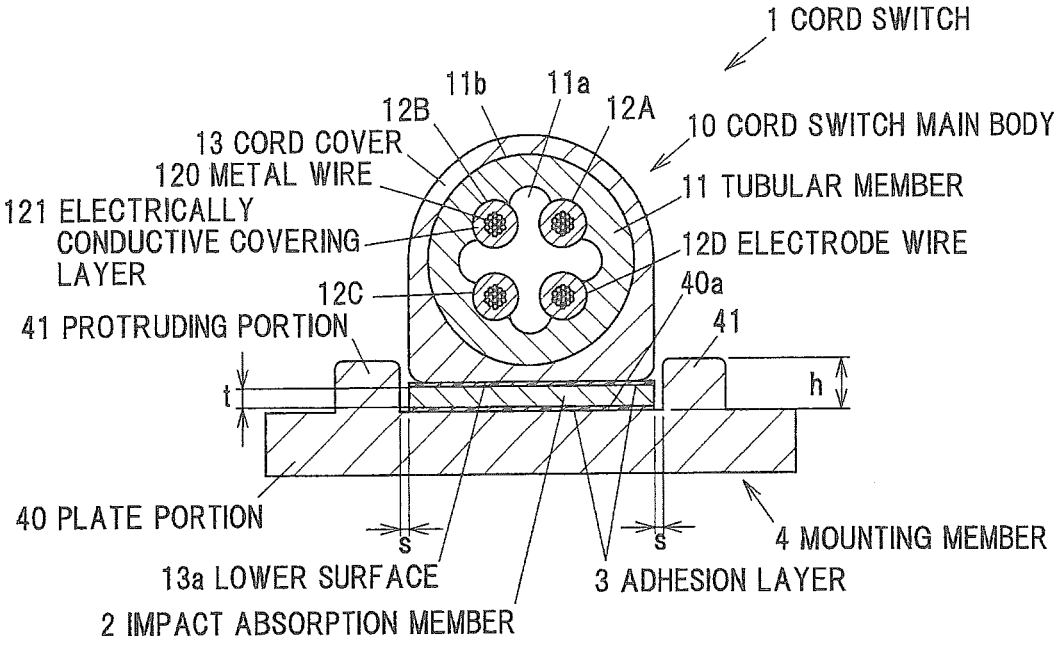
Figure 2B:
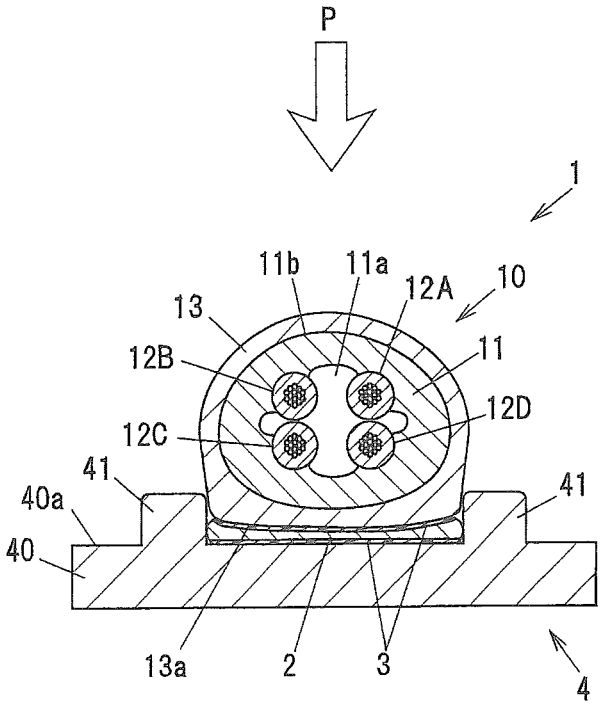

FIG. 1 is a perspective view of an essential part of a cord switch in the first embodiment according to the present invention. FIGS. 2A and 2B are cross-sectional views taken along A-A line of FIG. 1, wherein FIG. 2A shows the state where the load is applied to the cord switch, and FIG. 2B shows the state where the load is not applied to the cord switch, respectively.

A cord switch 1 comprises a cord switch main body 10, a mounting member (i.e. a member on which the cord switch will be mounted) 4 provided along the cord switch main body 10, and a strip-shaped impact (shock) absorption member 2 which is interposed between the cord switch main body 10 and the mounting member 4. The impact absorption member 2 is fixed to the cord switch main body 10 and the mounting member 4 by adhesion layers 3 which are provided on a front surface and a back surface of the mounting member 4, respectively.

The cord switch main body 10 comprises a hollow tubular member 11 having elasticity and electrical insulating property, a plurality of electrode wires 12A to 12D (collectively referred to as "electrode wires 12") provided to face each other with intervals at an inner surface of the tubular member 11, and a tubular cord cover 13 for covering the tubular member 11.

In the present embodiment, an outer surface 11*b* of the tubular member 11 is cylindrical, and the cord cover 13 is formed to have a flat surface as a part of an outer surface 11*b*. It should be noted that the electrode wires 12 are four (4) in number in the present embodiment, but the present invention is not limited thereto. The number of the electrode wires 12 may be the even number such as two (2) or six (6), and may be the odd number such as three (3) or five (5).

(Tubular Member)

The tubular member 11 is formed with a hollow portion 11*a* at a center of the tubular member 11. The hollow portion 11*a* has a cross-shape in its cross section perpendicular to a longitudinal direction. At the inner surface of the hollow portion 11*a*, the electrode wires 12 are held spirally (helically) in an electrically contactless state while the electrode wires 12 are partially exposed. The tubular member 11 has the elasticity (restoring force characteristic) by which the tubular member 11 will deform if the external force is applied thereto and will restore promptly if the external force disappears. As materials of the tubular member 11 having such a characteristic, e.g. rubber materials such as silicone rubber, ethylene-propylene rubber, styrene butadiene rubber, chloroprene rubber or elastomeric plastic may be used.

For elastomeric plastic, polyethylene, ethylene-vinyl acetate copolymer, ethylene ethyl acrylate copolymer, ethylene methyl methacrylate copolymer, polypropylene, polyvinyl chloride, olefin-based or styrene-based thermoplastic elastomer may be used. Also, the engineering plastic such as polyimide or polyamide may be used by devising a shape, thickness or the like of the parts.

(Electrode Wire)

The electrode wires 12A to 12D have the same configuration and arranged equidistantly at the inner surface of the hollow portion 11*a* of the tubular member 11. Further, the electrode wires 12A to 12D are placed helically within the tubular member 11. In the present embodiment, the electrode wires 12A to 12D are spaced from each other (in the contactless state) and held at the inner surface of the hollow portion 11*a* only by the elastic force of the tubular member 11. Each of the electrode wires 12A to 12D comprises a plurality of metal wires 120, and an electrically conductive covering layer 121 for covering the plurality of metal wires 120 collectively, and has a circular cross section. Each of the metal wires 120 comprises a metal stranded wire comprising a plurality of metal elemental wires stranded together for achieving excellent bendability and elasticity.

For example, the electrically conductive covering layer 121 comprises a mixture comprising rubber or elastomeric plastic blended with electrically conducting filler such as carbon black. A cross-sectional area of the electrically conductive covering layer 121 is preferably twice or more of a cross-sectional area of the metal wire 120. According to this feature, the elasticity enough for the electrode wire 12 is given, and the electrode wires 12 are appropriately held by the tubular member 11.

(Cord Cover)

The cord cover 13 is formed to have a tubular shape such that a hollow portion of the cord cover 13 accommodates the tubular member 11 which holds the electrode wires 12 to protect the electrode wires 12. The cord cover 13 further comprises a lower surface 13*a* which is flat in order to facilitate installation of the cord switch main body 10. The cord cover 13 may comprise e.g. polyurethane rubber, EP (ethylene propylene) rubber, silicone rubber, styrene butane diene rubber, chloroprene rubber, olefin-based or styrene-based thermoplastic elastomer, urethane resin, or the like.

(Impact Absorption Member)

The impact absorption member 2 has an elastic modulus that is lower than an elastic modulus of the tubular member 11, e.g. an elastic modulus of not less than $1\times10^5$ Pa and not greater than $1\times10^8$ Pa. If the elastic modulus is greater than $1\times10^8$ Pa, an impact absorption effect will be small, and if the elastic modulus is less than $1\times10^5$ Pa, the strength of the impact absorption member 2 per se will become weak and easily break. Here, the elastic modulus is a bulk modulus which is obtained by dividing an applied pressure by a volume change. The bulk modulus κ can be formally defined by the equation $\kappa=P/(\Delta V/V)$ where P is pressure, V is volume before deformation, and ΔV is of volume change by the pressure V. That is, the high elastic modulus means that a member is hard while the low elastic modulus means that the member is soft.

A thickness t (shown in FIG. 2A) of the impact absorption member 2 is preferably not less than 0.2 mm and not greater than 3 mm, more preferably not less than 0.4 mm and not greater than 2 mm. If the thickness t is less than 0.2 mm, an impact absorption effect will become small, while if the thickness t exceeds 3 mm, the cord switch 1 will become large in size so that the installation space will be restricted. Also, the impact absorption member 2 is fixed to a lower surface of the cord switch main body 10, i.e. and a lower surface 13*a* of the cord cover 13 and an upper surface 40*a* of the mounting member 4 by adhesion layers 3. It should be noted that the impact absorption member 2 may be fixed to the lower surface 13*a* of the cord cover 13 and the upper surface 40*a* of the mounting member 4 by adhesive such as epoxy, urethane, silicone, acrylic adhesives.

For the material of the impact absorption member 2, e.g. polyethylene, polypropylene, urethane, acrylic, rubbers such as ethylene propylene rubber or foamed material (cellular porous material) may be used. The foamed material is preferable since it has the impact absorption effect greater than that of rubber. When the foamed material is used as the material of the impact absorption member 2, an average diameter of air bubbles included in the foamed material is preferably not less than 0.1 μm and not greater than 500 μm. If the average diameter of air bubbles is less than 0.1 μm, the impact absorption effect will become small, while if it exceeds 500 μm, the strength of the impact absorption member 2 per se will become weak and be easily broken by the impact.

(Mounting Member)

The mounting member 4 comprises integrally (i.e. as one piece) a plate portion 40 as a main body for mounting the impact absorption member 2, and a pair of protruding portions 41 for sandwiching the impact absorption member 2 in a width direction which is perpendicular to a longitudinal direction of the impact absorption member 2, thereby restricting the deformation in the width direction of the impact absorption member 2. The pair of protruding portions 41 are spaced from each other with a distance greater than a dimension in the width direction of the impact absorption member 2 at the upper surface 40*a* of the mounting member 4.

In the present embodiment, the pair of protruding portions 41 are formed such that a gap is provided between the impact absorption member 2 and the pair of protruding portions 41. A gap dimension s (shown in FIG. 2A) in the width direction of the impact absorption member 2 is not less than 0.1 mm and not greater than 2 mm. If the gap dimension s is less than 0.1 mm, the impact absorption effect of the impact absorption member 2 with respect to the load applied from an inclined direction (a direction inclined to the upper surface 40*a* of the mounting member 4 in FIG. 2) cannot be expected enough, while if it exceeds 2 mm, a shift preventing effect of the impact absorption member 2 with respect to the load from the inclined direction cannot be expected.

The mounting member 4 has an elastic modulus higher than an elastic modulus of the tubular member 11. For the material of the mounting member 4, e.g. resins such as polyamide (nylon 6, nylon 66, etc.), ABS (Acrylonitrile Butadiene Styrene) resin, polypropylene, polyethylene, polycarbonate, acrylic resin, polybutylene terephthalate, polyethylene terephthalate, polyacetal resin or rubbers and the mixtures thereof as well as metals such as iron, copper, aluminum may be used, but the invention is not limited thereto.

Further, if the mounting member 4 does not include the protruding portions 41, when an external force is applied to the cord switch main body 10 from the parallel and lateral direction or the inclined direction with respect to the upper surface 40*a* of the mounting member 4, the impact absorption member 2 will be largely deformed in the lateral direction and the position of the cord switch main body 10 will be shifted largely so that the sensor reactivity as the switch will be deteriorated. In this embodiment, the shifting in the lateral direction of cord switch main body 10 can be suppressed because the lateral deformation of the impact absorption member 2 is restricted by the protruding portions 41. It should be noted that the protruding portions 41 may be omitted in the case that the cord switch 1 is not required to detect the external force from the lateral direction or the inclined direction.

The protruding portion 41 has a rectangular cross-section, and a height h (shown in FIG. 2A) from the upper surface 40*a* of the mounting member 4 is preferably not less than 0.3 times and not greater than 5 times of the thickness t of the impact absorption member 2. If it is less than 0.3 times, the effect of preventing the lateral shifting of the impact absorption member 2 will be deteriorated, while if it is greater than 5 times, the deformation of the cord switch main body 10 will be prevented so that the reactivity as the switch may be suppressed.

Figure 3:
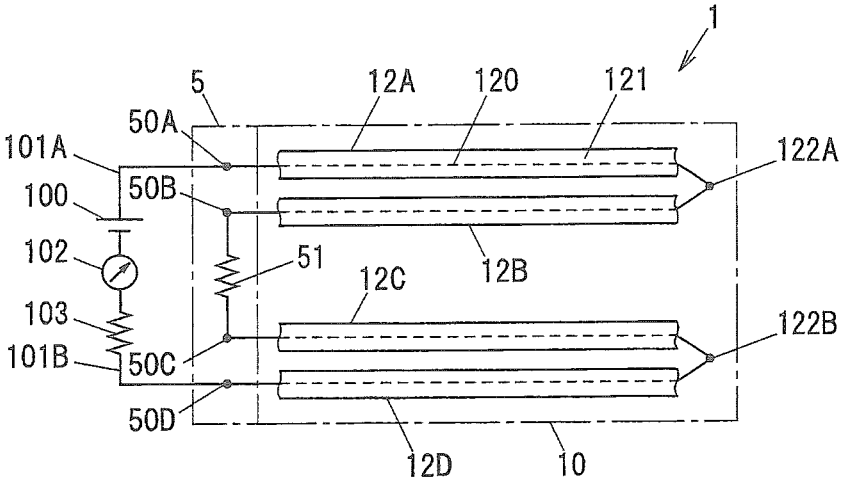
FIG. 3 is an explanatory diagram showing a circuit of the cord switch.

FIG. 3 is an explanatory diagram showing a circuit of the cord switch 1 in the first embodiment. A power supply 100 is electrically connected to the electrode wires 12A to 12D by the connection of a connector 5 to the cord switch 1. The connector 5 has terminals 50A to 50D to be electrically connected to the metal wires 120 of the electrode wires 12A to 12D, and a terminal 50B is connected to a terminal 50C via a resistor 51. The terminal 50A of the connector 5 is connected to a positive electrode of the power supply 100 through a wiring 101A. One end of an ammeter 102 is connected to a negative electrode of the power supply 100. The terminal 50D of the connector 5 is connected to another end of the ammeter 102 through a wiring 101B and a current-limiting resistor 103.

Also, ends of the electrode wires 12A, 12B on the opposite side to the connector 5 are connected to each other via a terminal 122A. Similarly, ends of the electrode wires 12C, 12D on the opposite side to the connector 5 are connected to each other via a terminal 122B.

(Operation of the Cord Switch)

As shown in FIG. 2B, when load P is applied to the cord switch main body 10 downwardly from the upper side, the impact absorption member 2 absorbs the impact of the load P and the thickness t becomes thin, and the impact absorption member 2 expands laterally to absorb the impact. Further, since the tubular member 11 of the cord switch main body 10 the hollow portion 11*a* is provided, the tubular member 11 transforms easily and swells laterally such that the cross-section thereof becomes an oval. As a result, the electrode wire 12A contacts the electrode wire 12D as well as the electrode wire 12B contacts the electrode wire 12C.

By the contact between the electrode wires 12A to 12D, a resistance value from the terminal 50A to the terminal 50D of the connector 5 changes. Also, the lateral deformation of the impact absorption member 2 is restricted by the protruding portions 41, so that the contact between the electrode wires 12 can be securely performed.

Herein, the physical relationship between the electrode wires 12A to 12D may be different from that shown in FIGS. 2A and 2B depending on the application position of the load P because the electrode wires 12A to 12D are helically located within the tubular member 11. Even in this case, a sensor function thereof is not deteriorated since a constant contact between the electrode wires 12 is securely provided.

When a short circuit occurs between the terminals 50A to 50D shown in FIG. 3 due to the contact between the electrode wires 12A to 12D, the current flowing through the ammeter 102 changes. ON/OFF signals can be generated by detecting the change of the current flowing through the ammeter 102 or by detecting the change of the electric current by a detecting circuit instead of the ammeter 102. It is possible to operate an alarm, control unit or the like provided outside using this ON/OFF signals.

(Effect of the First Embodiment)

According to the present embodiment, the following effects can be achieved.

(1) Since the impact absorption member 2 is provided between the cord switch main body 10 and the mounting member 4, when a large impact is applied to the cord switch main body 10, the impact can be absorbed by the impact absorption member 2 so that the break of the electrode wires 12 and the damage of the tubular member 11 can be suppressed.

(2) When the external force is applied to the cord switch main body 10 from the lateral direction or the inclined direction, the deformation in the width direction of the impact absorption member 2 can be restricted by the pair of protruding portions 41 provided at the mounting member 4 so that the sensor reactivity as the switch of the cord switch 1 can be provided securely.

(3) The tubular member 11 can be formed into a cylindrical shape by covering the tubular member 11 of the cord switch main body 10 with the cord cover 13 so that the production of the tubular member 11 becomes easy.

The Second Embodiment

Figure 4:
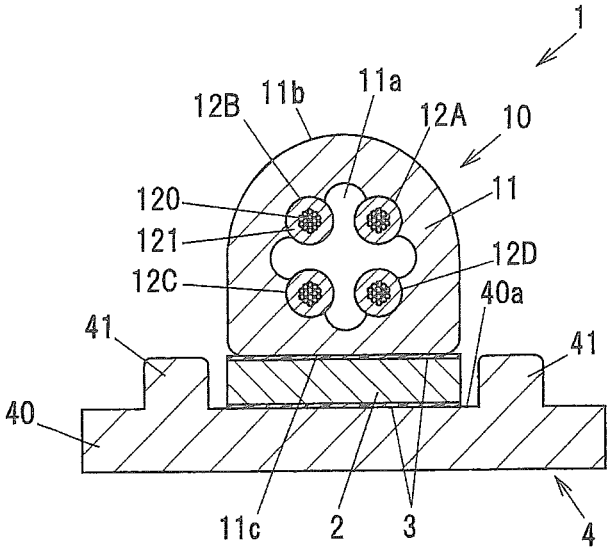
FIG. 4 is a cross-sectional view of the cord switch in the second embodiment according to the present invention.

FIG. 4 is a cross-sectional view of the cord switch in the second embodiment according to the present invention. In the first embodiment, the cord switch main body 10 having the cord cover 13 is used. In the present embodiment, the cord cover 13 is omitted. The second embodiment will be described below particularly about the differences from the first embodiment.

In the second embodiment, a cord switch 1 comprises a cord switch main body 10, a mounting member 4 on which the cord switch main body 10 is mounted, and an impact absorption member 2 for fixing the cord switch main body 10 to the mounting member 4 by adhesion layers 3, similarly to the first embodiment.

The cord switch main body 10 comprises a tubular member 11 having elasticity and electrical insulating property, and a plurality of electrode wires 12A to 12D provided to face each other with intervals at an inner surface of the tubular member 11.

The tubular member 11 in the second embodiment is formed with a cross-shaped hollow portion 11*a* at a center of the tubular member 11. In the tubular member 11, a part of an outer surface 11*b* is formed as a flat lower surface 11*c* which contact the adhesion layer 3. In the hollow portion 11*a*, a plurality (four in FIG. 4) of electrode wires 12 are held spirally (helically) in an electrically contactless state while the electrode wires 12 are partially exposed.

The impact absorption member 2 is fixed to a lower surface of the cord switch main body 10, i.e. and a lower surface 11*c* of the tubular member 11 and an upper surface 40*a* of the mounting member 4 by the adhesion layers 3.

(Effect of the Second Embodiment)

According to the second embodiment, the effects similar to the first embodiment can be achieved. Further, since the cord cover 13 becomes needless, the number of parts and components can be reduced in comparison with the first embodiment.

The Third Embodiment

Figure 5:
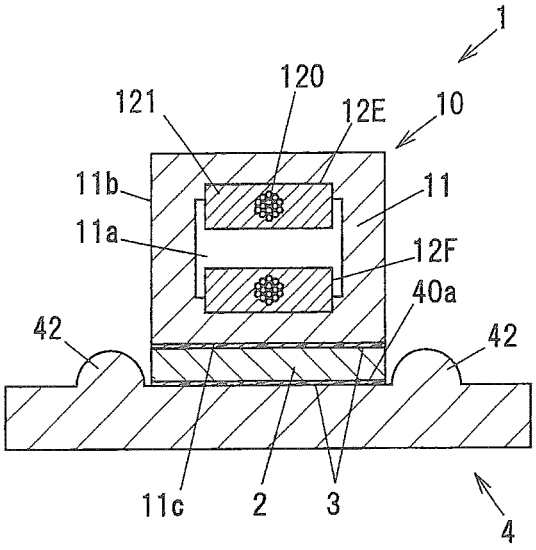
FIG. 5 is a cross-sectional view of the cord switch in the third embodiment according to the present invention.

FIG. 5 is a cross-sectional view of the cord switch in the third embodiment according to the present invention. A cord switch 1 in the third embodiment is different from the first and second embodiments in the shapes of the tubular member 11, electrode wires 12, and the mounting member 4. The second embodiment will be described below particularly about the differences from the first embodiment.

In the third embodiment, the cord switch 1 comprises a cord switch main body 10, a mounting member 4 on which the cord switch main body 10 is mounted, and an impact absorption member 2 for fixing the cord switch main body 10 to the mounting member 4 by adhesion layers 3, similarly to the first and second embodiments.

The cord switch main body 10 comprises a tubular member 11 having elasticity, and a pair of electrode wires 12E, 12F provided to face each other with an interval at an inner surface of the tubular member 11.

The tubular member 11 in the third embodiment is formed with a hollow portion 11*a* having a rectangular cross-section at a center of the tubular member 11. An outer surface 11*b* of the tubular member 11 has a rectangular cross section, and a part of the outer surface 11*b* is formed as a flat lower surface 11*c*. In the hollow portion 11*a*, the pair of electrode wires 12E, 12F are held in an electrically contactless state while the pair of electrode wires 12E, 12F are partially exposed.

The pair of electrode wires 12E, 12F have the same configuration and are placed to face each other and linearly as well as parallel with each other at the inner surface of tubular member 11. Each of the electrode wires 12E, 12F has a rectangular cross-section, and comprises a plurality of metal wires 120, and an electrically conductive covering layer 121 for covering the plurality of metal wires 120 collectively.

The impact absorption member 2 is fixed to a lower surface of the cord switch main body 10, i.e. and a lower surface 11*c* of the tubular member 11 and an upper surface 40*a* of the mounting member 4 by the adhesion layers 3.

The mounting member 4 comprises a plate portion 40 as a main body, and a pair of protruding portions 42 for restricting the width direction deformation of the mounting member 4. Each of the protruding portions 42 has a semi-circular cross-section. The pair of protruding portions 42 are spaced from each other with a distance greater than the width of the impact absorption member 2. Although no gap may be provided between the pair of protruding portions 42 and the impact absorption member 2, a gap of not less than 0.1 mm and not greater than 2 mm may be preferably provided therebetween. If the gap dimension is less than 0.1 mm, the impact absorption effect with respect to the load applied from the inclined direction cannot be expected enough, while if it exceeds 2 mm, a shift preventing effect of the impact absorption member 2 with respect to the load from the inclined direction cannot be expected.

A thickness of the impact absorption member 2 is preferably not less than 0.2 mm and not greater than 3 mm, more preferably not less than 0.4 mm and not greater than 2 mm. A height from the upper surface 40*a* of the plate portion 40 of the protruding portion 42 is preferably not less than 0.3 times and not greater than 5 times of the thickness of the impact absorption member 2. If it is less than 0.3 times, the effect of preventing the lateral shifting of the impact absorption member 2 will be deteriorated, while if it is greater than 5 times, the deformation of the cord switch 1 will be prevented so that the reactivity as the switch may be suppressed.

(Effects of the Third Embodiment)

According to the third embodiment, the effects similar to the first and second embodiments can be achieved. Further, since the number of the electrode wires is two, the number of parts and components can be reduced in comparison with the first and second embodiments. Further, as to the load from the direction that is substantially perpendicular to the upper surface 40*a* of the mounting member 4, a stable electrical conduction can be achieved since a contact area between the electrode wires 12E, 12F is greater than a contact area between the electrode wires 12A to 12D having the circular cross-section.

The Fourth Embodiment

Figure 6:
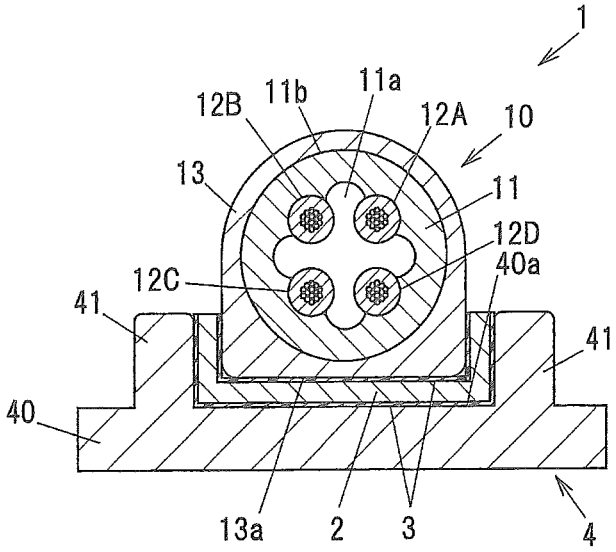
FIG. 6 is a cross-sectional view of the cord switch in the fourth embodiment according to the present invention.

FIG. 6 is a cross-sectional view of the cord switch in the fourth embodiment according to the present invention. In the first embodiment, the impact absorption member 2 is placed between the lower surface of the cord switch main body 10 and the upper surface 40*a* of the mounting member 4. In the present embodiment, the impact absorption member 2 is also placed between the cord switch main body 10 and the protruding portions 41 of the mounting member 4. The fourth embodiment will be described below particularly about the differences from the first embodiment.

In the fourth embodiment, the cord switch 1 comprises a cord switch main body 10, a mounting member 4 on which the cord switch main body 10 is mounted, and an impact absorption member 2 for fixing the cord switch main body 10 to the mounting member 4 by adhesion layers 3, similarly to the first embodiment.

The impact absorption member 2 is provided between the lower surface of the cord switch main body 10 and the upper surface 40*a* of the mounting member 4 as well as between side surfaces of the cord switch main body 10 (the cord cover 13) and the protruding portions 41. The impact absorption member 2 is fixed to the lower surface of the cord switch main body 10, i.e. the lower surface 13*a* of the cord cover 13 and the upper surface 40*a* of the mounting member 4 as well as the side surfaces of the cord cover 13 and inner side surfaces of the protruding portions 41 by the adhesion layers 3.

(Effects of the Fourth Embodiment)

According to the third embodiment, the effects similar to the first embodiment can be achieved. Further, it is possible to absorb the impact due to the external force from the lateral direction or the inclined direction more easily in comparison with the first embodiment.

The Fifth Embodiment

Figure 7:
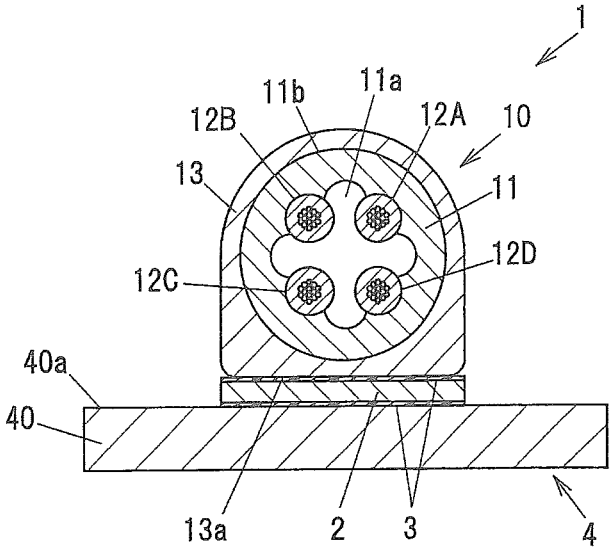
FIG. 7 is a cross-sectional view of the cord switch in the fifth embodiment according to the present invention.

FIG. 7 is a cross-sectional view of the cord switch in the fifth embodiment according to the present invention. In the first embodiment, the mounting member 4 having the protruding portions 41 is used. In the fifth embodiment, the mounting member 4 does not have the protruding portions 41. The fifth embodiment will be described below particularly about the differences from the first embodiment.

In the fifth embodiment, the cord switch 1 comprises a cord switch main body 10, a mounting member 4 on which the cord switch main body 10 is mounted, and an impact absorption member 2 for fixing the cord switch main body 10 to the mounting member 4 by adhesion layers 3, similarly to the first embodiment. The mounting member 4 of the present embodiment is consisted of a flat plate portion 40, and the protruding portions 41 in the first embodiment are not provided.

The impact absorption member 2 is fixed to the lower surface of the cord switch main body 10, i.e. the lower surface 13*a* of the cord cover 13 and the upper surface 40*a* of the mounting member 4.

(Effects of the Fifth Embodiment)

According to the present embodiment, since the impact absorption member 2 is provided between the cord switch main body 10 and the mounting member 4, when a large impact is applied to the cord switch main body 10, the impact can be absorbed by the impact absorption member 2 so that the break of the electrode wires 12 and the damage of the tubular member 11 can be suppressed.

Examples

Next, examples of the present invention will be described below.

(1) Preparation of Samples

For examples 1 to 7, trial products (samples) of the cord switch 1 corresponding to the first embodiment were prepared. The cross-sectional size of the cord switch main body 10 of the sample was 5 mm in width and 6 mm in height. For the material of the cord cover 13, urethane resin was used.

For the impact absorption member 2, two kinds were prepared. The first one comprises a polyethylene foamed material (expansion ratio of 2 times) of 0.8 mm in thickness and 5 mm in width, on both side surfaces of which acrylic adhesive was applied as adhesion layers 3. The second one comprises an acrylic foamed material (expansion ratio 1.5 times) of 1.2 mm in thickness and 5 mm in width, on both side surfaces of which acrylic adhesive was applied as adhesion layers 3.

For the material of the mounting member 4, nylon 6 was used. The samples in which the height of the protruding portions 41 of the mounting member 4 was varied as 0.3 mm, 0.4 mm, 0.8 mm, 1.2 mm, 2.0 mm, 3.0 mm, and 4.0 mm as shown in Table 1 were prepared. A distance between the protruding portions 41 was 6 mm.

The cord switch main body 10 was cut into a piece having a length of 50 cm and attached to the mounting member 4 via the impact absorption member 2.

(2) Evaluation of Samples

To these samples, an impact test, an inclined load (impact) test and a reactivity test were performed.

(Impact Test)

Figure 8:
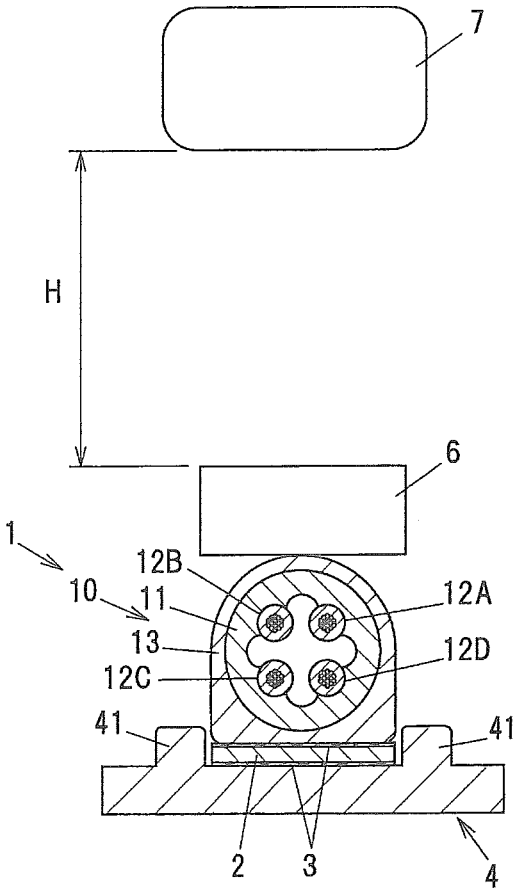
FIG. 8 is an explanatory diagram for showing the impact test method.

The impact test was performed as follows. As shown in FIG. 8, an aluminum column jig 6 of 4 mm in diameter was placed on the cord switch 1, and a weight 7 of 2 kg was dropped on the column jig 6 from a height H of 2 cm. When the electrode wires 12 of the cord switch 1 were not broken, the sample was judged as "pass" (○). When the electrode wires 12 of the cord switch 1 was broken, the sample was judged as "failure" (X).

(Inclined Load Test)

Figure 9:
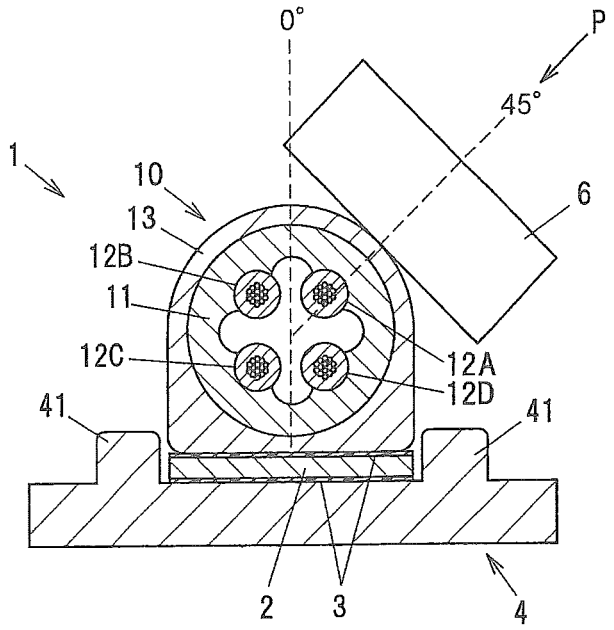
FIG. 9 is an explanatory diagram for showing the inclined load test.

The inclined load test was performed as follows. As shown in FIG. 9, the cord switch 1 was pushed via the column jig 6 of 4 mm in diameter by the force of 20N from the direction inclined by 45 degrees with respect to the mounting member 4. When the electrode wires 12 of the cord switch 1 contacted each other and the cord switch 1 reacted as the switch, the sample was judged as "pass" (○). When the electrode wires 12 of the cord switch 1 did not contact each other so that the cord switch 1 did not react as the switch, the sample was judged as "failure" (X).

(Reactivity Test)

The reactivity test was performed as follows. The cord switch 1 was pushed via the column jig 6 of 4 mm in diameter under the load of 2 kg downwardly from the upside in the direction perpendicular to the upper surface 40*a* of the mounting member 4. When the electrode wires 12 of the cord switch 1 contacted each other and the cord switch 1 reacted as the switch, the sample was judged as "pass" (○). When the electrode wires 12 of the cord switch 1 did not contact each other so that the cord switch 1 did not react as the switch, the sample was judged as "failure" (X).

Table 1 shows evaluation results of respective examples 1 to 7. It should be noted that, as shown in Table 1, the cord switches in Examples 6 and 7 can be used enough depending on the purpose of use of the cord switch 1 although the result was "failure" (X) in the inclined load test in Example 6 and the reactivity test in Example 7.

TABLE 1

| Items | | Example 1 | Example 2 | Example 3 | Example 4 | Example 5 | Example 6 | Example 7 |
|---|---|---|---|---|---|---|---|---|
| Impact absorption member | Material | polyethylene foamed material | acrylic foamed material | polyethylene foamed material | acrylic foamed material | polyethylene foamed material | acrylic foamed material | polyethylene foamed material |

TABLE 1-continued

| Items | | Example 1 | Example 2 | Example 3 | Example 4 | Example 5 | Example 6 | Example 7 |
|---|---|---|---|---|---|---|---|---|
| Mounting member | Thickness | 0.8 mm | 1.2 mm | 0.8 mm | 1.2 mm | 0.8 mm | 1.2 mm | 0.8 mm |
| | Height of protruding Portion | 0.4 mm | 0.8 mm | 1.2 mm | 2.0 mm | 3.0 mm | 0.3 mm | 4.0 mm |
| Ratio of height of protruding portion to thickness of impact absorption member | | 0.5 times | 0.67 times | 1.5 times | 1.7 times | 3.8 times | 0.25 times | 5.0 times |
| Evaluation results | Impact test | ○ | ○ | ○ | ○ | ○ | ○ | ○ |
| | Inclined load test | ○ | ○ | ○ | ○ | ○ | X | ○ |
| | Reactivity test | ○ | ○ | ○ | ○ | ○ | ○ | X |

Comparative Examples

Next, comparative examples will be described.

(1) Preparation of Samples

The cord switch in comparative examples 1 and 2 were prepared as follows. The cord switch main body 10 was fixed by adhesive directly to the mounting member 4 without providing the impact absorption member 2.

The mounting member 4 was similar to those used in Examples 1 to 7 except that the protruding portions 41 were not provided. Also, the samples of the cord switch main body 10 were prepared similarly to those used in Examples 1 to 7. The adhesive was applied at a coating thickness of 0.1 mm using two kinds of two-part adhesives, namely, urethane-based two-part adhesive and epoxy-based two-part adhesive.

(2) Evaluation of the Samples

The impact test similar to that has been carried out for Examples 1 to 7 was carried out for Comparative examples 1 and 2.

TABLE 2

| Items | | Comparative example 1 | Comparative example 2 |
|---|---|---|---|
| Adhesive | Material | Urethane-based | Epoxy-based |
| | Coating thickness | 0.1 mm | 0.1 mm |
| Evaluation result | Impact test | x | x |

As shown in Table 1 and Table 2, the result of the impact test was "failure" (X) in Comparative examples 1 and 2, in which the impact absorption member 2 was not provided between the cord switch main body 10 and the mounting member 4 while the result of the impact test was "pass" (○) in Examples 1 to 7, in which the impact absorption member 2 was provided between the cord switch main body 10 and the mounting member 4. Thereby, it was confirmed that the damage of the cord switch 1 was suppressed by the impact absorption member 2.

(Summary of Embodiment)

Next, technical ideas grasped from the embodiments described above will be described with reference numerals used in the explanation of the embodiment. However, the reference numerals in the following description do not limit the components in the appended claims to the members or the like concretely shown in the embodiments.

[1] A cord switch (1) comprising: a cord switch main body (10) comprising a hollow tubular member (11) having elasticity and electrical insulating property and a plurality of electrode wires (12) provided to face each other with an interval at an inner surface of the tubular member (11) and spaced from each other by the elasticity of the tubular member (11); a mounting member (4) having an elastic modulus greater than an elastic modulus of the tubular member (11) and being provided along the cord switch main body (10); and a strip-shaped impact absorption member (2) having an elastic modulus lower than the elastic modulus of the tubular member (11) and being interposed between the cord switch main body (10) and the mounting member (4).

[2] The cord switch (1) according to [1], wherein the mounting member (4) comprises a main body (40) for mounting the impact absorption member (2), and a pair of protruding portions (41, 42) for sandwiching the impact absorption member (2) in a width direction which is perpendicular to a longitudinal direction of the impact absorption member (2), thereby restricting a deformation in the width direction of the impact absorption member (2).

[3] The cord switch (1) according to [2], wherein a gap is provided between the impact absorption member (2) and the pair of protruding portions (41, 42), and a dimension (s) of the gap in the width direction is not less than 0.1 mm and not greater than 2 mm.

[4] The cord switch (1) according to [2] or [3], wherein a height of the pair of protruding portions (41, 42) from the mounting member (4) is not less than 0.3 times and not greater than 5 times of the thickness of the impact absorption member (2).

[5] The cord switch (1) according to any one of [1] to [3], wherein the elastic modulus of the impact absorption member (2) is not less than $1\times10^5$ Pa and not greater than $1\times10^8$ Pa.

[6] The cord switch (1) according to any one of [1] to [5], wherein the thickness (t) of the impact absorption member (2) is not less than 0.2 mm and not greater than 3 mm. [7] The cord switch (1) according to any one of [1] to [6], wherein that the impact absorption member (2) comprises a foamed material.

[8] A cord switch mounting structure for mounting a cord switch main body (10) comprising a hollow tubular member (11) having elasticity and electrical insulating property and a plurality of electrode wires (12) provided to face each other with an interval at an inner surface of the tubular member (11) on a mounting member (4) having an elastic modulus greater than an elastic modulus of the tubular member (11), comprising a strip-shaped impact absorption member (2) having an elastic modulus lower than the elastic modulus of the tubular member (11) and being interposed between the cord switch main body (10) and the mounting member (4).

[9] The cord switch mounting structure according to [8], wherein the mounting member (4) comprises a main body (40) for mounting the impact absorption member (2), and a pair of protruding portions (41, 42) for sandwiching the impact absorption member (2) in a width direction which is perpendicular to a longitudinal direction of the impact absorption member (2), thereby restricting a deformation in the width direction of the impact absorption member (2).

Although the present invention has been described above in relation to the embodiments, the embodiments described above are not intended to limit the invention according to the claims. It should also be noted that all combinations of the features described in the embodiments are not necessarily essential for the means for solving the problems of the present invention.

Further, the present invention may be appropriately modified within a scope of the invention without going beyond the spirit of the invention. For example, in the second to fourth embodiments, the protruding portion 41 or the protruding portion 42 may be omitted.

As the embodiments for achieving the object of the invention, the cord switch 1 comprising the cord switch main body 10, the impact absorption member 2, the adhesion layers 3 and the mounting member 4 is described above. The object of the invention can be however achieved as a mounting structure of the cord switch for mounting the cord switch main body 10 on the mounting member 4. In this case, the mounting member 4 can be constructed as e.g. a bracket which is fixed to a sliding door of a vehicle.

What is claimed is:

1. A cord switch mounting structure for mounting a cord switch main body comprising a hollow tubular member having elasticity and electrical insulating property and a plurality of electrode wires provided to face each other with an interval at an inner surface of the tubular member on a mounting member having an elastic modulus greater than an elastic modulus of the tubular member, comprising:

a strip-shaped impact absorption member having an elastic modulus lower than the elastic modulus of the tubular member and being interposed between the cord switch main body and the mounting member.

2. The cord switch mounting structure according to claim 1, wherein the mounting member comprises a main body for mounting the impact absorption member, and a pair of protruding portions for sandwiching the impact absorption member in a width direction which is perpendicular to a longitudinal direction of the impact absorption member, thereby restricting a deformation in the width direction of the impact absorption member.

3. A cord switch comprising:

a cord switch main body comprising a hollow tubular member having elasticity and electrical insulating property and a plurality of electrode wires provided to face each other with an interval at an inner surface of the tubular member and spaced from each other by the elasticity of the tubular member;

a mounting member having an elastic modulus greater than an elastic modulus of the tubular member and being provided along the cord switch main body; and a strip-shaped impact absorption member having an elastic modulus lower than the elastic modulus of the tubular member and being interposed between the cord switch main body and the mounting member.

4. The cord switch according to claim 3, wherein the elastic modulus of the impact absorption member is not less than $1\times10^5$ Pa and not greater than $1\times10^8$ Pa.

5. The cord switch according to claim 3, wherein the thickness of the impact absorption member is not less than 0.2 mm and not greater than 3 mm.

6. The cord switch according to claim 3, wherein that the impact absorption member comprises a foamed material.

7. The cord switch, according to claim 3, wherein the mounting member comprises a main body for mounting the impact absorption member, and a pair of protruding portions for sandwiching the impact absorption member in a width direction which is perpendicular to a longitudinal direction of the impact absorption member, thereby restricting a deformation in the width direction of the impact absorption member.

8. The cord switch, according to claim 7, wherein a gap is provided between the impact absorption member and the pair of protruding portions, and a dimension of the gap in the width direction is not less than 0.1 mm and not greater than 2 mm.

9. The cord switch according to claim 7, wherein a height of the pair of protruding portions from the mounting member is not less than 0.3 times and not greater than 5 times of the thickness of the impact absorption member.

* * * * *